US005788466A

United States Patent [19]

Thompson

[11] Patent Number: 5,788,466

[45] Date of Patent: Aug. 4, 1998

[54] IRRIGATION BOOSTER PUMP SYSTEM

[76] Inventor: Andy L. Thompson, R.R. 1, Box 35, Courtland, Kans. 66939

[21] Appl. No.: 674,104

[22] Filed: Jul. 1, 1996

[51] Int. Cl.[6] ..... F04B 17/03; F04B 23/00

[52] U.S. Cl. ..... 417/360; 239/724; 137/565

[58] Field of Search ..... 417/360, 452, 417/423.3, 423.15, 423.14, 424.1; 137/565; 111/118; 239/724, 725, 726

[56] References Cited

U.S. PATENT DOCUMENTS

| | | | |
|---|---|---|---|
| 779,052 | 1/1905 | Pope | 239/724 |
| 3,799,690 | 3/1974 | Klaas | 417/424.1 X |
| 4,970,973 | 11/1990 | Lyle et al. | 239/726 X |
| 4,995,790 | 2/1991 | Schill et al. | 417/360 |
| 5,076,762 | 12/1991 | Lykes et al. | 417/360 X |
| 5,265,810 | 11/1993 | Chapman | 239/724 |
| 5,529,462 | 6/1996 | Hawes | 417/360 |

*Primary Examiner*—Ismael Izaguirre
*Attorney, Agent, or Firm*—Jeffrey L. Thompson

[57] ABSTRACT

An irrigation booster pump assembly that includes a frame assembly, a power supply supported by the frame assembly, a vertical drive shaft rotatably supported by the frame assembly, and a propeller. The vertical drive shaft has an upper end drivingly connected to an output shaft of the power supply. A propeller is mounted on a lower end of the vertical drive shaft. The propeller has blades or vanes pitched for pushing water in a downward direction away from the power supply during normal operation of the power supply. The pump assembly further includes a cylindrical member disposed concentrically about the propeller, the cylindrical member rotatably supporting a lower end portion of the vertical drive shaft. The cylindrical member is connected to the frame assembly by a plurality of circumferentially spaced elongated rods, each rod having one end fixed to the frame assembly and another end fixed to the cylindrical member. A lift lug assembly is connected to the frame assembly and extends over the power supply for lifting the pump assembly. A cover assembly is mounted to the lift lug assembly for covering and protecting the pump assembly.

20 Claims, 6 Drawing Sheets

IRRIGATION BOOSTER PUMP SYSTEM

BACKGROUND OF THE INVENTION

1. Field of the Invention

The present invention relates generally to irrigation systems and, in particular, to a booster pump system for increasing the flow rate of irrigation water.

2. Description of the Prior Art

Farmers have been irrigating crops for many years, perhaps as early as 2000 B.C. Today, there are well over 40 million acres of land irrigated in the United States alone.

There are several basic types of irrigation systems in use today, including furrow irrigation, sprinkler irrigation, and subsurface drip irrigation. Variations of each of these basic types of irrigation systems are used to adapt to different water sources, availability of labor, field topography, field size, energy sources, and so forth.

Furrow irrigation systems, which are common in areas having gently sloping fields, may use open ditches, syphon tubes, gated pipes (aluminum or plastic), or hoses (rubber or plastic) to distribute water to fields. In systems using pipes or hoses, the pipes or hoses are typically laid across an elevated end of a furrowed field and supplied with water under pressure from a pump or a gravity flow arrangement. The water then flows out of the pipe or hose through openings in a side wall of the pipe or hose, which openings are opened and closed with conventional valve or plug devices. The water flowing out of the pipe or hose is channeled down individual furrows in the field where it soaks into the soil for uptake by the crops.

Water can be supplied to the pipes or hoses by a variety of pump systems or by gravity flow arrangements receiving water from an irrigation canal. Systems using gated pipes and hoses are generally preferred today over open ditches and syphon tube systems because they require substantially less labor and can be more closely managed for water conservation and precision application.

Referring to FIG. 1 of the drawings, a conventional irrigation system 10 in which water is supplied by gravity flow to a pipe or hose will be described. In the conventional system 10, an irrigation canal 11 carrying water from an upstream reservoir, for example, is tapped for water to irrigate an individual field 12. A dual canal gate assembly 13 is provided on a side of the canal 11 to control the amount of water taken from the canal 11. The canal gate assembly 13 may have a first inlet gate 14 on a side closest to the canal 11, and a second outlet gate 15 spaced from the first inlet gate 14. The dual gate arrangement permits a flow rate of water taken from the canal 11 to be accurately measured and controlled.

An outlet 16 of the canal gate assembly 13 is connected by an underground pipe 17 to an open box structure 20 for venting the flow and for screening trash out of the irrigation water. The box structure 20 is provided with an inlet 21 for receiving water under gravity flow from the irrigation canal 11, which is located at a higher elevation than the field 12 to be irrigated. The box structure 20 has an outlet 22 in fluid communication with a pipe or hose 23 for distributing water across the field 12 to be irrigated. The pipe or hose 23 has individual valves or openings 24 for permitting water to flow out of the pipe or hose 23 and channeled down individual furrows in the field 12. A screen 25 is provided in the box structure 20 between the inlet 21 and outlet 22 for preventing trash, fish, crawdads, and other debris from entering the pipe or hose 23. Without the screen 25, the individual valves and openings 24 in the pipeline 23 tend to become clogged during irrigating.

In the conventional system 10, the flow rate through the pipe or hose 23 is limited by a small elevation differential between the box structure 20 and the irrigation canal 11. In these systems, a booster pump system (not shown) can be used to increase water flow through the pipeline. The booster pump can, for example, be placed in a pipeline segment 26 leading away from the box structure 20. The function of such a booster pump is to increase the pressure or velocity of the water in the pipeline 23 to more efficiently and quickly irrigate a field.

A problem with existing irrigation booster pump systems is that they require a water seal or water-tight bearing to prevent water from leaking around shafts or other moving components of the pump. For example, a conventional horizontal drive booster pump has a horizontal rotating drive shaft extending through a wall of the pump system at a point below the water level in the pump system. The horizontal shaft must be sealed to prevent water from leaking through the wall of the pump system.

Another problem with existing booster pump systems is that the power supply (e.g., electric motor or internal combustion engine) is often placed at a level such that the power supply becomes submerged if a leak or other malfunction in the water supply occurs. The existing irrigation booster pumps also suffer from a lack of adaptability to existing irrigation systems and are difficult to set up and take down. Thus, there is a need for an improved booster pump system that solves the above problems.

SUMMARY OF THE INVENTION

It is an object of the present invention to provide an irrigation system that solves the above-mentioned problems of the prior art systems.

It is a further object of the present invention to provide a booster pump for an irrigation system that is convenient to use, keeps the power supply elevated above the water level, can be easily removed for servicing and storage during the off season, and provides an effective and efficient increase in the flow rate through an irrigation pipeline.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects, the present invention provides an irrigation booster pump assembly that sits on top of a box structure and pushes water through an outlet in the bottom surface of the box structure. The pump assembly includes a frame having a lower portion for supporting a propeller and an upper portion for mounting a power supply, such as an electric motor or an internal combustion engine. The power supply has a vertical output drive shaft connected to a vertical shaft on which the propeller is mounted. The pump assembly can be easily lifted as a unit and moved from the box structure for use at another location or for servicing or storage during the off season.

More specifically, in accordance with a first aspect of the present invention, an irrigation system is provided comprising a water supply, a box structure having an open top, an inlet, and an outlet, the inlet being in fluid communication with the water supply, a system for distributing water across a field to be irrigated, the distributing system being in fluid communication with the outlet of the box structure, and a booster pump assembly having a power supply and a propeller, the power supply being supported above a water level in the box structure, the propeller being mounted on a generally vertical drive shaft for rotation adjacent the outlet of the box structure for increasing a flow rate of water through the outlet, and the power supply being drivingly connected to the drive shaft.

The booster pump assembly preferably is supported on a top surface of the box structure by a supporting frame. The booster pump assembly further comprises a cylindrical member, and a plurality of circumferentially spaced elongated rods connected between the cylindrical member and the supporting frame. The propeller is rotatably supported within the cylindrical member. The booster pump assembly is removable from the box structure as a single unit.

The outlet in the box structure preferably extends vertically downward through a bottom surface of the box structure. The outlet in the box structure preferably comprises a pipe member having an inner diameter that is slightly larger than an outer diameter of the cylindrical member, and the cylindrical member is inserted at least partially into the pipe member.

A screen assembly is preferably mounted in the box structure between the inlet and the outlet such that all water flowing through the box structure passes through the screen assembly. A lift lug is fixed to the booster pump assembly and extends over the power supply, the lift lug having an apex at a highest portion thereof. A threaded member is secured to the apex of the lift lug. A cover assembly is secured to the lift lug by the threaded member. A threaded clevis having threads for cooperating with the threads of the threaded member provides a lift point for lifting the booster pump from the box structure.

In accordance with another aspect of the present invention, an irrigation booster pump assembly is provided comprising a frame assembly, a power supply having an output shaft, the power supply being supported by the frame assembly, a vertical drive shaft rotatably supported by the frame assembly, the vertical drive shaft having an upper end drivingly connected to the output shaft of the power supply, and a propeller mounted on a lower end of the vertical drive shaft, the propeller having means for pushing water in a downward direction away from the power supply.

A cylindrical member is preferably disposed concentrically about the propeller, the cylindrical member rotatably supporting a lower end portion of the vertical drive shaft. The cylindrical member is connected to the frame assembly by a plurality of circumferentially spaced elongated rods, each rod being parallel to the vertical drive shaft and having one end fixed to the frame assembly and another end fixed to the cylindrical member.

The frame assembly preferably comprises a first pair of parallel support members spaced from each other for resting on a support surface, a second pair of parallel members spaced from each other and secured across a top surface of the first pair of support members perpendicular to the first pair of support members, and a power supply mounting portion fixed to the second pair of parallel members for mounting the power supply to the frame assembly.

In accordance with yet another aspect of the present invention, an apparatus is provided for increasing the flow rate of water in an irrigation system, comprising a box structure having an inlet, an outlet, and an open top, and a booster pump assembly comprising a power supply, a propeller, and a drive shaft connected between the power supply and the propeller for rotatably driving the propeller. The booster pump assembly is supported on a top surface of the box structure, the drive shaft extends vertically from the power supply to the propeller, and the propeller is rotatably mounted adjacent the outlet. The outlet is preferably located in a bottom surface of the box structure. The propeller has means for pushing water through the outlet in a downward direction away from the power supply.

BRIEF DESCRIPTION OF THE DRAWINGS

The present invention will become more clearly appreciated as the disclosure of the present invention is made with reference to the accompanying drawings. In the drawings.

DESCRIPTION OF THE INVENTION

Referring to FIGS. 2 to 6 of the drawings, an irrigation system 30 and booster pump assembly 50 according to the present invention will be described. In a preferred embodiment, the booster pump assembly 50 is used to boost water flow and/or pressure in a pipeline 31 for supplying water to a furrowed field 32 to be irrigated.

Figure 1:
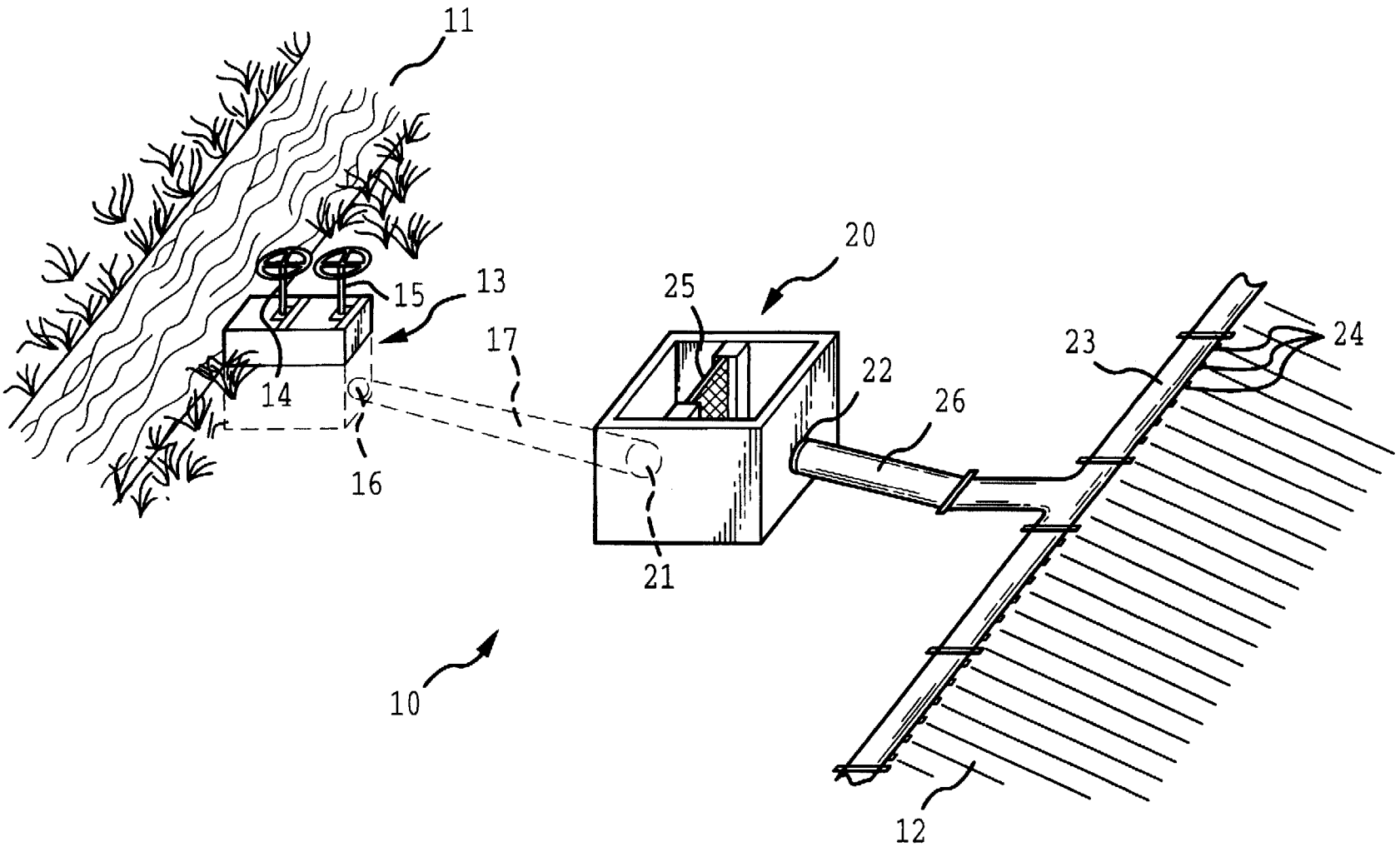
(PRIOR ART) FIG.1
FIG. 1 is a perspective view showing a conventional irrigation system for distributing irrigation water from an open canal by gravity flow.
Figure 2:
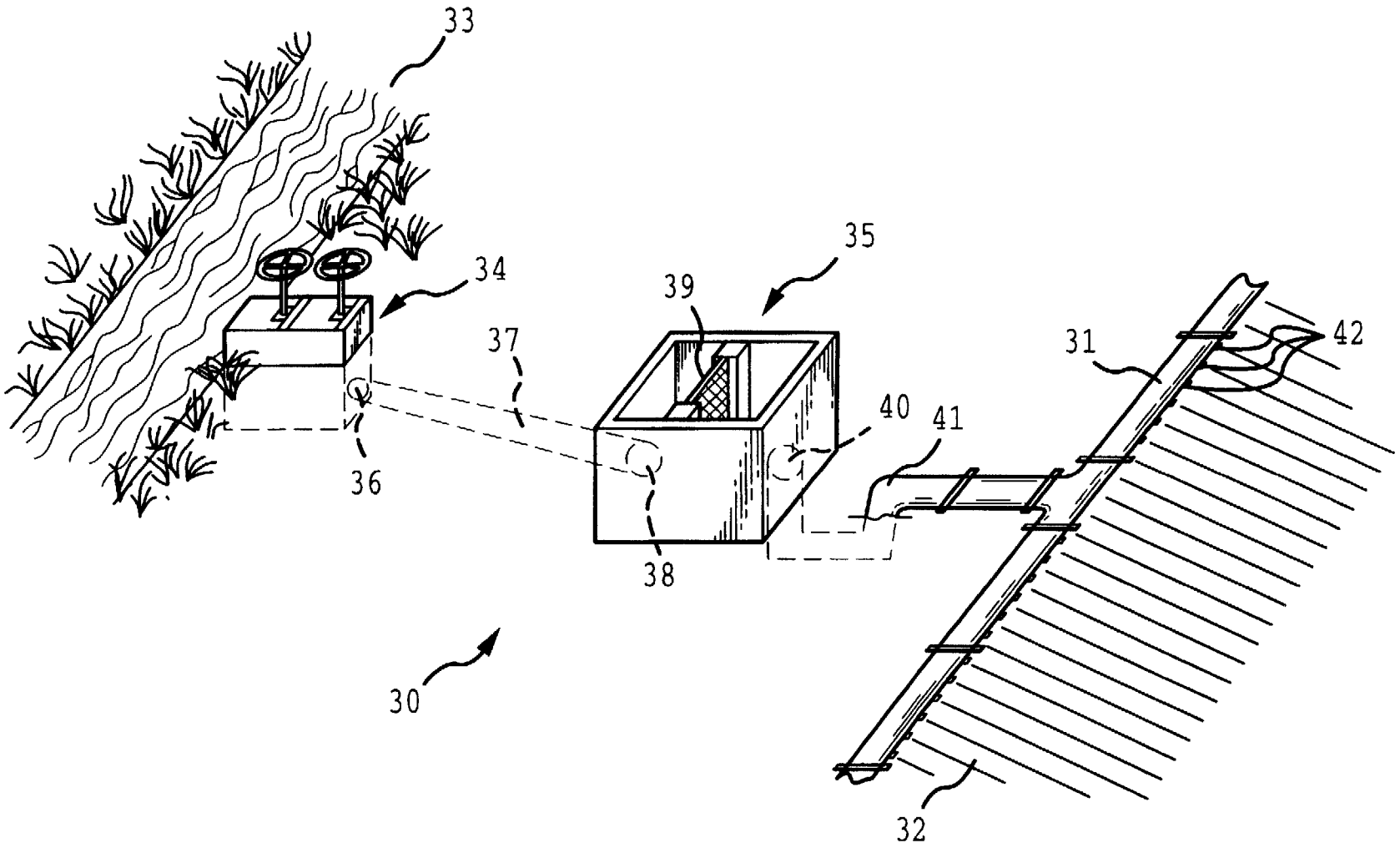
FIG. 2 is a perspective view showing an irrigation system modified for use with the irrigation booster pump assembly of the present invention.

The irrigation system 30 shown in FIG. 2 includes a conventional irrigation canal 33, which can be tapped for water to irrigate an individual field 32. A conventional dual canal gate assembly 34 is provided on a side of the canal 33 to control the amount of water taken from the canal 33 and supplied to an open box structure 35. An outlet 36 of the canal gate assembly 34 is connected by an underground pipe 37 to the open box structure 35 for venting the flow and for screening trash out of the irrigation water. The box structure 35 is provided with an inlet 38 for receiving water under gravity flow from the irrigation canal 33. The irrigation canal 33 is located at a higher elevation than the field 32 to be irrigated.

Figure 3:
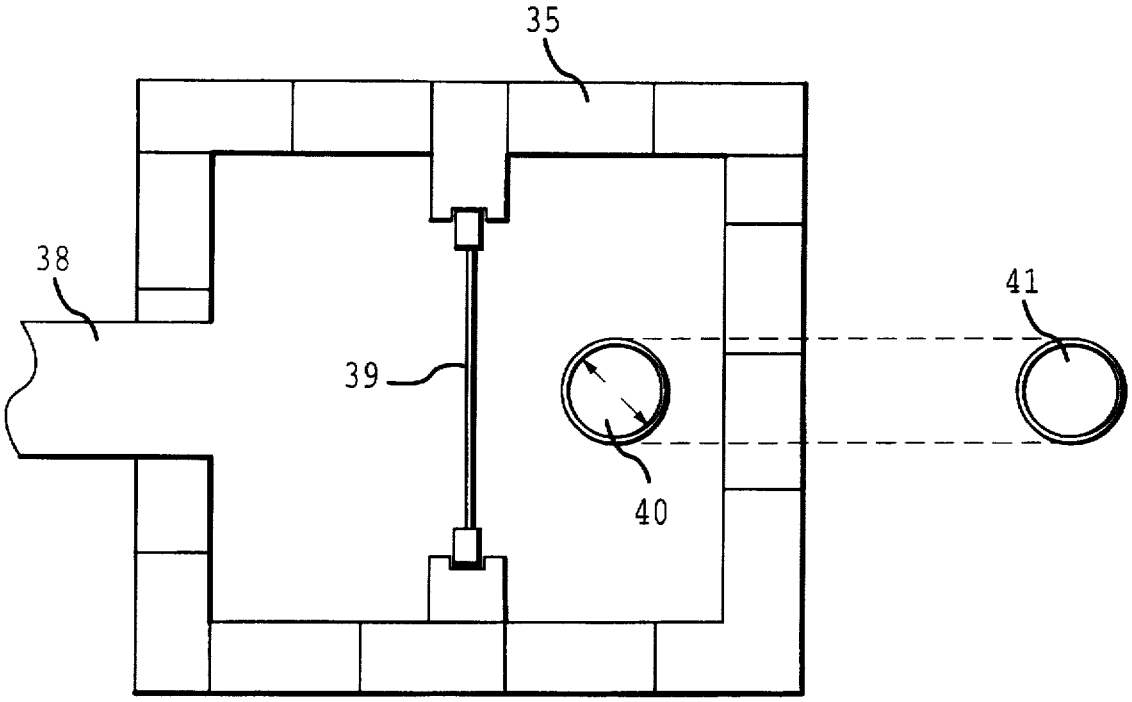
FIG. 3 is a plan view of the box structure of the irrigation system shown in FIG. 2.
Figure 4:
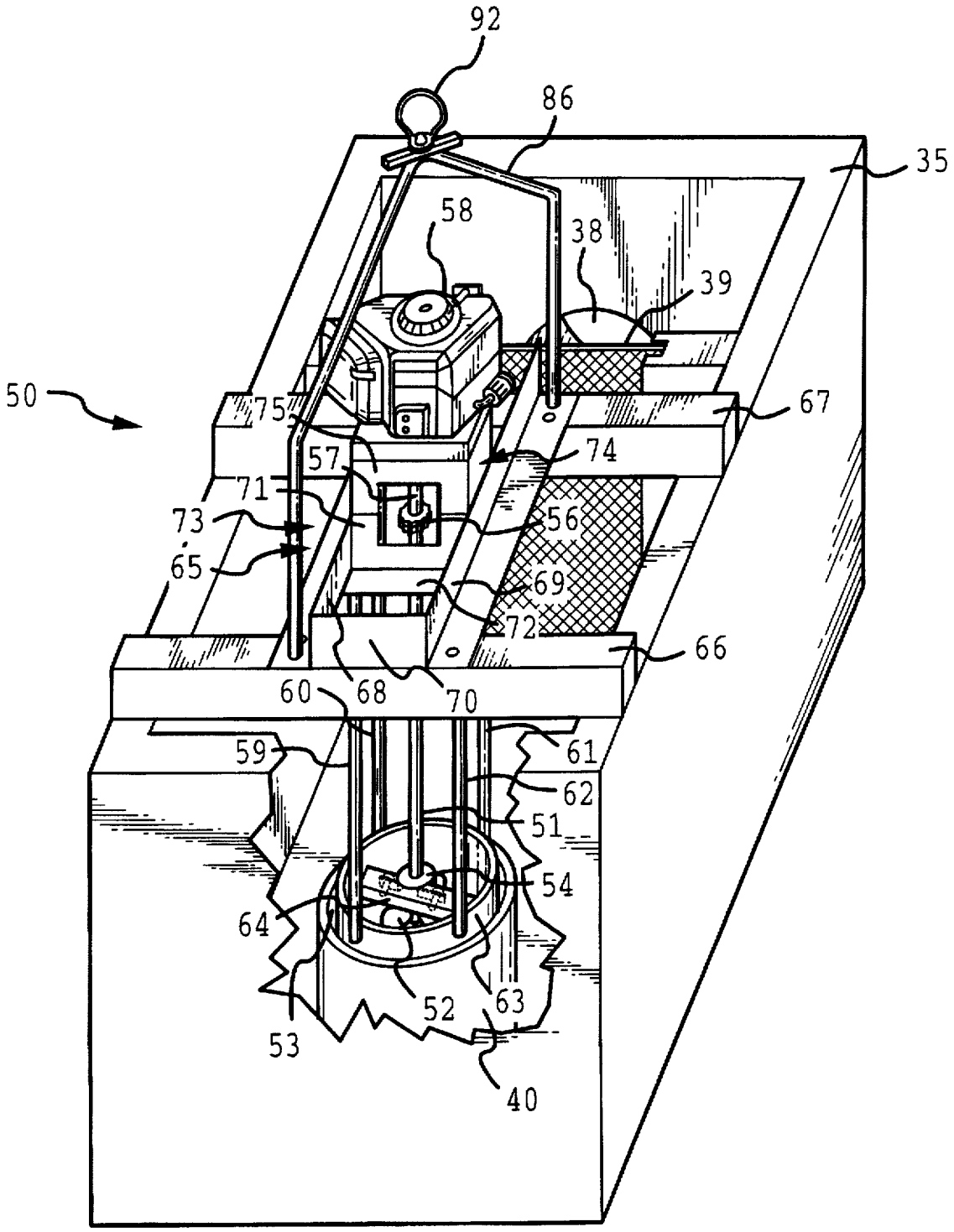
FIG. 4 is a perspective view of the irrigation booster pump assembly of the present invention mounted on a partially cut-away box structure.
Figure 5:
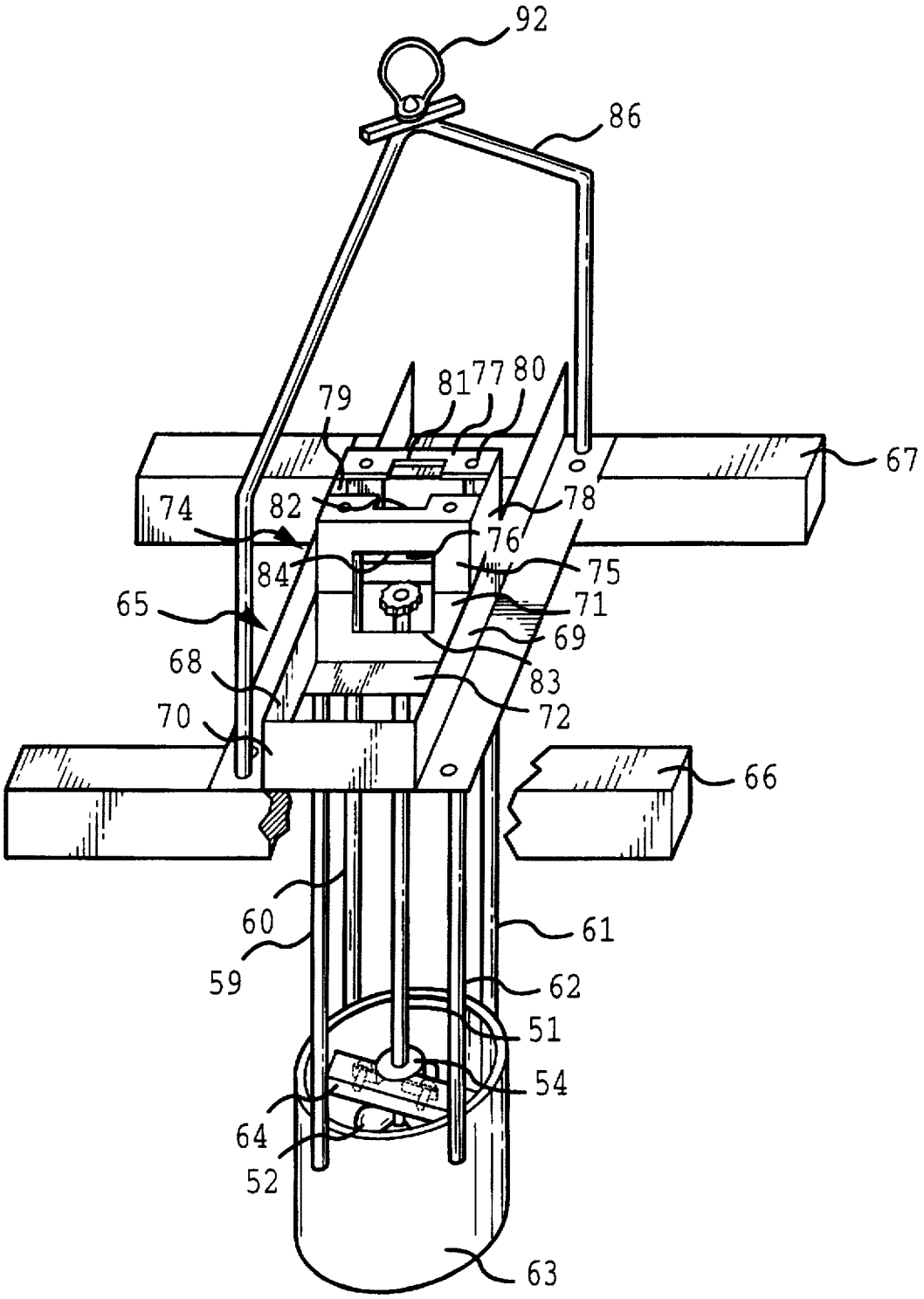
FIG. 5 is a partially cut-away perspective view of the irrigation booster pump of the present invention with the power supply removed.

The box structure 35 has a screen 39 for removing trash from the water flowing through the box structure 35. As shown in FIGS. 2 and 3, an outlet pipe 40 extends through a bottom wall of the box structure 35 on an opposite side of the screen 39 from the inlet 38. The outlet pipe 40 is placed in fluid communication with an irrigation pipeline 31 or the like via a riser assembly 41 and other suitable connection pieces for distributing water across the field 32 to be irrigated. In operation, water flows into the box structure 35 through the inlet 38, flows through the screen 39, and then exits through the outlet pipe 40 into the riser 41. The water then flows through the irrigation pipeline 31 and is dispensed to the field 32 to be irrigated through gated or valved openings 42 in the side wall of the irrigation pipeline 31.

When an elevation of the field 32 to be irrigated is close to the same elevation as the water in the irrigation canal 33 supplying water to the system, a booster pump may be necessary to provide an adequate water flow rate through the irrigation pipeline 31. The booster pump assembly 50 of the present invention will now be described with reference to FIGS. 4 to 6.

The booster pump assembly 50 comprises a rotatably driven vertical shaft 51 with a propeller 52 fixed to a lower end and positioned in an opening 53 of the outlet pipe 40 near the bottom of the box structure 35. The propeller 52 comprises a plurality of pitched vanes or blades that rotate with the rotation of the vertical shaft 51. The propeller 52 develops a pumping head within the outlet pipe 40 and the irrigation pipeline 31 by a propelling action of the pitched vanes or blades rotating in the water within the outlet pipe 40.

Figure 6:
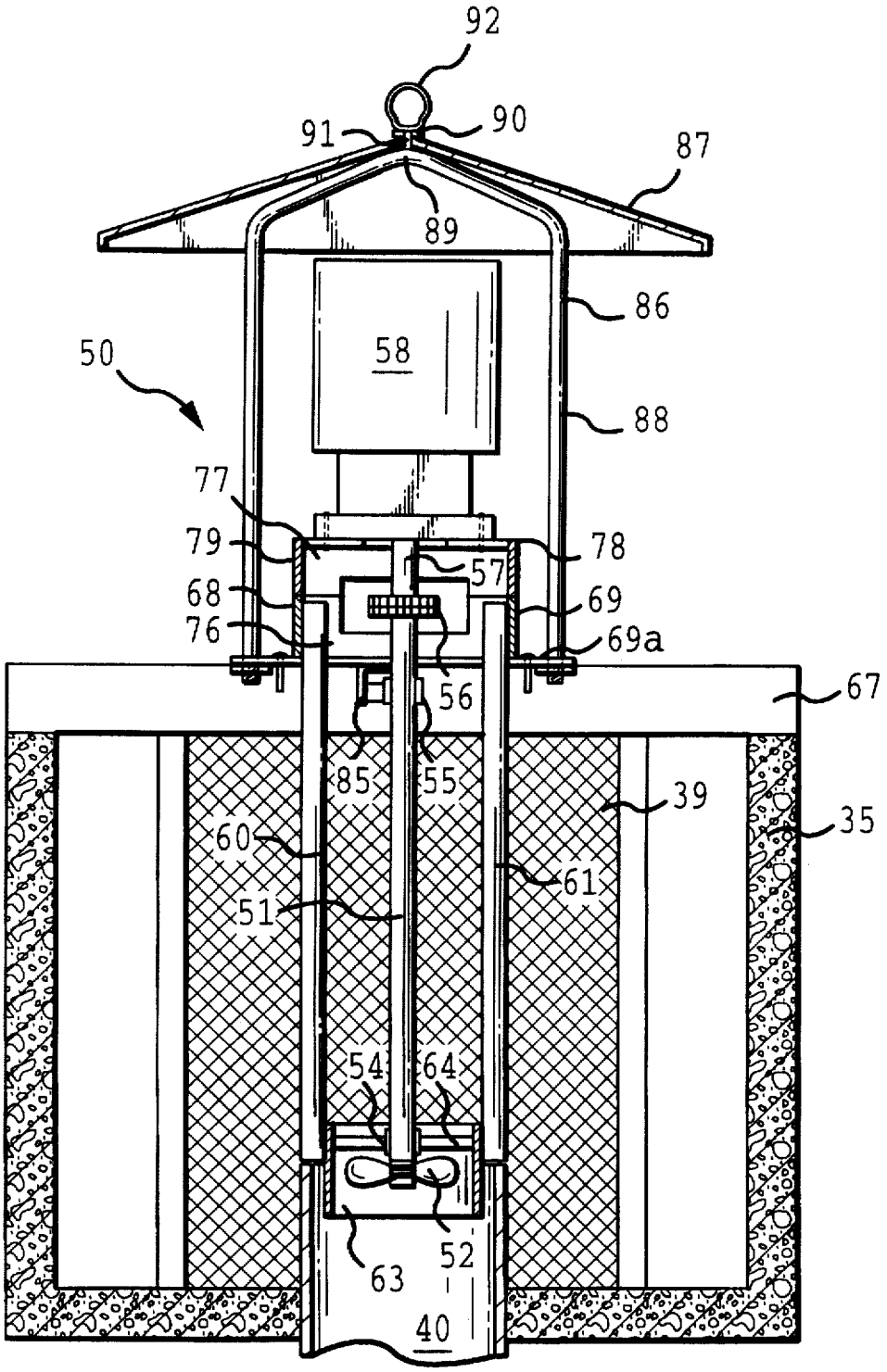
FIG. 6 is a front view of the irrigation booster pump assembly of the present invention mounted on the box structure and equipped with a lift lug and protective cover assembly.

The vertical shaft 51 is stabilized at its lower end near the propeller 52 by a lower bearing 54, preferably a bearing adapted to operate in water, and at its upper end by an upper bearing 55 (e.g., a pillow block bearing) or the like (FIG. 6). The vertical shaft 51 is drivingly connected via a sprocket and chain connector 56 to a vertical drive shaft 57 of a power supply 58 (e.g., an electric motor or an internal combustion engine). For example, an excellent power supply 58 for the booster pump 50 for a normal size irrigation project using an 8 to 10 inch diameter pipeline is a 16 to 20 hp internal combustion engine equipped to burn propane.

The vertical shaft 51 is surrounded concentrically in a cage-like manner by four elongated vertical rods 59, 60, 61, 62 which provide protection and support to the vertical shaft 51 while allowing a free flow of water to the outlet 40 and propeller 52. The rods 59, 60, 61, 62 are fixed at their bottom ends to an outside surface of a short cylindrical member 63. The cylindrical member 63 extends below the rods 59, 60, 61, 62 at least a short distance and has a slightly smaller outer diameter than an inner diameter of the outlet pipe 40 of the box structure 35. Thus, the cylindrical member 63 can be inserted into the outlet pipe 40 a short distance during operation to align the propeller 52 with the outlet pipe 40.

The lower bearing 54 is supported within the cylindrical member 63 by an angle iron member 64 or the like welded to an inner surface of the cylindrical member 63. The vertical shaft 51 is rotatably supported by the bearing 54. The propeller 52 is mounted to a free end of the vertical shaft 51 for rotation within the cylindrical member 63.

The power supply 58 is supported above the box structure 35 by a bracket assembly 65 that rests upon first and second supports 66, 67 extending across the top surface of the box structure 35. The supports 66, 67 can be, for example, wooden beams having a 4 inch by 4 inch cross-section.

The bracket assembly 65 comprises first and second angle iron members 68, 69 extending orthogonally relative to the supports 66, 67. The respective ends of the first and second members 68, 69 are secured to a top surface of the supports 66, 67 by suitable connector devices 69*a* (e.g., screws, bolts, etc.). A third angle iron member 70 extends between the first and second members 68, 69 at a first end thereof and has a bottom horizontal flange (not shown) extending toward an opposite end of the first and second members 68, 69. A fourth angle iron member 71 extends between the first and second members 68, 69 at an intermediate portion thereof and has a bottom horizontal flange 72 extending toward the third member 70.

An open receptacle 73 is defined by the bracket assembly 65 having first and second sides formed by the first and second members 68, 69, respectively, third and fourth sides formed by the third and fourth members 70, 71, respectively, and a bottom surface formed by the bottom flanges of the third and fourth members 70, 71. The open receptacle 73 provides a location for mounting a battery (not shown) for operating an electric starter of an internal combustion engine power supply.

The bracket assembly 65 further includes a motor mount portion 74 for supporting the power supply 58. The motor mount portion 74 comprises a fifth angle iron member 75 mounted above the fourth member 71, and sixth and seventh angle iron members 76, 77 (FIG. 5) that are mounted in a substantially mirror image fashion to the fourth and fifth members 71, 75, respectively. The motor mount portion 74 further includes eighth and ninth members 78, 79 (FIG. 5), which are plate members having their lower edges fixed to the top edges of the first and second members 68, 69, respectively. The top edges and ends of the eighth and ninth members 78, 79 are fixed to corresponding portions of the fifth and seventh members 75, 77.

The fifth and seventh members 75, 77 each have apertures 80 for mounting the power supply 58 on an upper surface thereof. The fifth and seventh members 75, 77 also have cut-out portions 81, 82 through which the vertical drive shaft 57 of the power supply 58 extends. Additional cut-out portions 83, 84 are provided in the fourth, fifth, sixth, and seventh members 71, 75, 76, 77 on respective side portions of the motor mount portion 74 for permitting access to the sprocket and chain connector 56 for connecting and disconnecting the vertical drive shaft 57 of the power supply 58 to the vertical shaft 51.

As seen in FIG. 6, an angle iron member 85 is secured to a bottom surface of the fourth and sixth members 71, 76 at an intermediate location of the fourth and sixth members 71, 76. The upper bearing 55 supporting the upper end of the vertical shaft 51 is secured to the angle iron member 85.

The present invention also includes a lift lug 86 and cover assembly 87. The lift lug 86 comprises a rod member 88 fixed to the first and second members 68, 69 (or to the supports 66, 67) by suitable means such as welding or threaded connectors. The rod member 88 of the lift lug 86 extends upwardly from the first and second members 68, 69 and over the top of the power supply 58. An apex 89 is formed in the rod member 88 at an uppermost portion of the lift lug 86. The lift lug 86 is constructed and designed to be able to support the entire pump assembly 50 when lifted from the apex 89 of the lift lug 86.

The cover assembly 87 is fixed to the apex 89 of the lift lug 86 (FIG. 6). The cover assembly 87 has an aperture in its apex 90 for receiving a threaded stud 91 that extends upwardly from the apex 89 of the lift lug 86. The cover assembly 87 shields the power supply 58 from the sun and rain to improve operating performance and increase the life of the pump system. The cover assembly 87 can be obtained, for example, from a slightly modified lid of an existing livestock feeder/waterer.

In a preferred embodiment, a threaded clevis member 92 is threaded onto the stud 91 to hold the cover assembly 87 in place. The clevis member 92 can be engaged by suitable lifting means, such as a tractor loader, to lift and transport the pump assembly 50 from the box structure 35.

Other means can be used to connect the cover assembly 87 to the lift lug 86. For example, a threaded wing nut (not shown) could be threaded over the threaded stud on the lift lug. The wing nut could be easily removed to permit easy removal of the cover assembly 87. Upon removing the cover assembly 87 from the lift lug 86, a chain or clevis could then be easily connected to the apex 89 of the lift lug 86, and the entire pump assembly 50 can be lifted and transported away from the box structure 35 using, for example, a tractor loader.

As will be appreciated from the above description, the pump assembly 50 is designed to be easily removed from the box structure 35 for safe storage when not in use. The pump assembly 50 can therefore be quickly and easily transported from the field to an enclosed building or the like for safe storage during the off-season.

The pump assembly 50 can be driven by a conventional vertical drive shaft motor 58 direct-drive connected to the pump propeller 52 for operation of the motor 58 from a position completely above the water level. No water seals are required for the pump assembly 50 of the present invention since the drive shaft 51 extends through the top surface of the water in the box structure 35. The present invention also provides easy installation and removal from existing box structures.

It will be appreciated that the various embodiments of the present invention are not limited to the exact construction that has been described above and illustrated in the accompanying drawings, and that various modifications and changes can be made without departing from the scope and spirit of the invention. It is intended that the scope of the invention protected only be limited by the appended claims.

What is claimed is:

1. An irrigation system comprising:

a water supply;

a box structure having an open top, an inlet, and an outlet, said inlet being in fluid communication with said water supply;

a system for distributing water across a field to be irrigated, said distributing system being in fluid communication with said outlet of said box structure; and a booster pump assembly having a power supply and a propeller, said power supply being supported above a water level in said box structure, said propeller being mounted on a generally vertical drive shaft for rotation adjacent the outlet of the box structure for increasing a flow rate of water through said outlet, said power supply being drivingly connected to said drive shaft.

2. The irrigation system according to claim 1, wherein said booster pump assembly is supported on a top surface of said box structure by a supporting frame, said booster pump assembly further comprising a cylindrical member, and a plurality of circumferentially spaced elongated rods connected between said cylindrical member and said supporting frame, said propeller being rotatably supported within said cylindrical member.

3. The irrigation system according to claim 1, wherein said booster pump assembly is removable from said box structure as a single unit.

4. The irrigation system according to claim 1, wherein said outlet in the box structure extends vertically downward through a bottom surface of the box structure.

5. The irrigation system according to claim 2, wherein said outlet in the box structure comprises a pipe member, said pipe member having an inner diameter that is slightly larger than an outer diameter of said cylindrical member, said cylindrical member being inserted at least partially into said pipe member.

6. The irrigation system according to claim 1, further comprising a screen assembly mounted in said box structure between said inlet and said outlet such that all water flowing through said box structure passes through said screen assembly.

7. The irrigation system according to claim 1, further comprising a lift lug fixed to said booster pump assembly and extending over said power supply, said lift lug having an apex at a highest portion thereof.

8. The irrigation system according to claim 7, further comprising a threaded member secured to said apex of the lift lug and a cover assembly secured to said lift lug by said threaded member.

9. The irrigation system according to claim 8, further comprising a threaded clevis having threads for cooperating with threads of said threaded member, said clevis providing a lift point for lifting said booster pump from said box structure.

10. An irrigation booster pump assembly comprising:

a frame assembly;

a power supply having an output shaft, said power supply being supported by said frame assembly;

a vertical drive shaft rotatably supported by said frame assembly, said vertical drive s haft having an upper end drivingly connected to the output shaft of said power supply;

a propeller mounted on a lower end of said vertical drive shaft, said propeller having means for pushing water in a downward direction away from said power supply.

11. The irrigation booster pump assembly according to claim 10, further comprising a cylindrical member disposed concentrically about said propeller, said cylindrical member rotatably supporting a lower end portion of said vertical drive shaft, said cylindrical member being connected to said frame assembly by a plurality of circumferentially spaced members.

12. The irrigation booster pump assembly according to claim 11, wherein said circumferentially spaced members are elongated rods, each rod having one end fixed to said frame assembly and another end fixed to said cylindrical member.

13. The irrigation booster pump assembly according to claim 12, wherein said elongated rods are parallel to said vertical drive shaft.

14. The irrigation booster pump assembly according to claim 10, further comprising a lift lug assembly connected to said frame assembly and extending over said power supply, said lift lug assembly providing a lifting point for lifting said pump assembly.

15. The irrigation booster pump assembly according to claim 10, wherein said power supply is an internal combustion engine, and said output shaft extends vertically downward from said engine.

16. The irrigation booster pump assembly according to claim 10, further comprising a cover assembly mounted to said lift lug assembly for covering and protecting the pump assembly.

17. The irrigation booster pump assembly according to claim 10, wherein said frame assembly comprises a first pair of parallel support members spaced from each other for resting on a support surface, a second pair of parallel members spaced from each other and secured across a top surface of said first pair of support members perpendicular to said first pair of support members, and a power supply mounting portion fixed to said second pair of parallel members for mounting said power supply to said frame assembly.

18. The apparatus according to claim 16, wherein said booster pump assembly is removable from said box structure as a single unit.

19. An apparatus for increasing the flow rate of water in an irrigation system, comprising:

a box structure having an inlet, an outlet, and an open top; and a booster pump assembly comprising a power supply, a propeller, and a drive shaft connected between said power supply and said propeller for rotatably driving said propeller;

wherein said booster pump assembly is supported on a top surface of said box structure, said drive shaft extends vertically from said power supply to said propeller, and said propeller is rotatably mounted adjacent said outlet.

20. The apparatus according to claim 19, wherein said outlet is located in a bottom surface of said box structure, and said propeller has means for pushing water through said outlet in a downward direction away from said power supply.

* * * * *